United States Patent [19]

Itoyama et al.

[11] Patent Number: 4,735,254

[45] Date of Patent: Apr. 5, 1988

[54] METHOD AND APPARATUS FOR CASTING ENDLESS STRIP

[75] Inventors: Seiji Itoyama; Hakaru Nakato; Tsutomu Nozaki; Yasuhiro Habu; Nagayasu Bessho; Tetsuya Fujii, all of Chiba, Japan

[73] Assignee: Kawasaki Steel Corporation, Hyogo, Japan

[21] Appl. No.: 879,278

[22] Filed: Jun. 27, 1986

[30] Foreign Application Priority Data

| | | | |
|---|---|---|---|
| Jun. 27, 1985 | [JP] | Japan | 60-96576[U] |
| Aug. 30, 1985 | [JP] | Japan | 60-189965 |
| Apr. 14, 1986 | [JP] | Japan | 61-84234 |
| Apr. 16, 1986 | [JP] | Japan | 61-86204 |

[51] Int. Cl.[4] ..... B22D 11/06; B22D 11/16

[52] U.S. Cl. ..... 164/481; 164/154; 164/432; 164/440; 164/452; 164/490

[58] Field of Search ..... 164/454, 481, 413, 431, 164/432, 490, 452, 154, 440

[56] References Cited

U.S. PATENT DOCUMENTS

| | | | |
|---|---|---|---|
| 3,633,654 | 1/1972 | Auman et al. | 164/432 |
| 4,341,259 | 7/1982 | Lavener | 164/454 |
| 4,648,438 | 3/1987 | Hazelett et al. | 164/481 X |

FOREIGN PATENT DOCUMENTS

| | | | |
|---|---|---|---|
| 0071802 | 2/1983 | European Pat. Off. | 164/481 |
| 56-151143 | 11/1981 | Japan | 164/432 |
| 59-104256 | 6/1984 | Japan | 164/481 |
| 59-153553 | 9/1984 | Japan | 164/432 |

*Primary Examiner*—Nicholas P. Godici
*Assistant Examiner*—J. Reed Batten, Jr.
*Attorney, Agent, or Firm*—Austin R. Miller

[57] ABSTRACT

A method and apparatus for continuous casting of an elongated thin metal strip achieves substantially high yield without allowing break-out or sticking. The method for casting a continuous elongated metal strip includes a step of driving endless belts at a varying speed so as to apply jerks to the slightly and half-solidified metal that release the metal from the surfaces of the stationary side walls. Applying jerks to the casting chamber by varying the driving speed of the endless belt ensures that the solidifying metal will travel smoothly and thus ensures a high manufacturing yield.

25 Claims, 6 Drawing Sheets

METHOD AND APPARATUS FOR CASTING ENDLESS STRIP

BACKGROUND OF THE INVENTION

1. Field of the Invention

The present invention relates generally to a method for casting an elongated continuous metal strip and an apparatus, a so-called "belt-caster", capable of carrying out the method. More particularly, the invention relates to a method and apparatus for casting an elongated continuous metal strip from molten metal and which provides a relatively high yield.

2. Description of the Prior Art

Japanese Patent First Publication No. (Tokkai) Showa 59-153553 discloses an apparatus for casting an elongated continuous metal strip. This conventional casting apparatus has a pair of endless belts which define a casting chamber together with side walls covering the lateral edges of the casting chamber. Molten metal is supplied to the casting chamber via an inlet and driven toward the outlet of the casting chamber continuously by means of pinch rollers downstream of the belts. As the metal travels toward the outlet, the belts and the side walls of the casting chamber cool the metal into an elongated, continuous, thin metal strip or plate.

During this casting process, the side walls tend to retard the movement of the solidifying metal in the casting chamber. The resulting friction exerts stress on the metal passing through the casting chamber. Since the metal is still only partially solidified, this friction may cause the metal strip to shear across its width, resulting in a disastrous interruption of the continuous feed commonly called "break-out". Naturally, this will occur any time the feeding force fails to overcome the frictional force. Sticking of the solidified metal onto the opposing surface of the side wall may also cause this kind of friction.

SUMMARY OF THE INVENTION

Therefore, it is an object of the present invention to provide a method or process for continuous casting of an elongated thin metal strip.

Another object of the present invention is to provide a method for casting a continuous elongated metal strip without allowing break-out or sticking.

In order to accomplish the aforementioned and other objects, a method for casting a continuous elongated metal strip according to the present invention includes a step of driving endless belts at a varying speed so as to apply jerks to the slightly and half-solidified metal that release the metal from the surfaces of the side walls.

Applying jerks to the casting chamber by varying the driving speed of the endless belts ensures that the solidifying metal will travel smoothly and thus ensures a high manufacturing yield.

According to one aspect of the invention, a method for casting a continuous metal strip comprising the steps of:

defining an elongated casting chamber with a pair of stationary walls and a pair of endless belts, the casting chamber having an inlet for molten metal and an outlet for a cast metal strip;

continuously supplying molten metal through the inlet;

withdrawing metal out of the casting chamber through the outlet at a constant speed;

solidifying the molten metal supplied through the inlet as it travels toward the outlet within the chamber; and driving the endless belts at a varying speed, thereby applying jerk to the solidifying metal within the casting chamber so as to keep the solidified metal separate from the stationary walls.

In the method as set forth above, the driving speed of the endless belts cyclically varies between a given highest speed and a given lower speed at a given frequency. The highest speed is set above the withdrawal speed of metal strip and the lowest speed is set below the withdrawal speed. The highest speed is more than $V_c/200$ (m/min) higher than the withdrawal speed, where $V_c$ is the withdrawal speed, and the lowest speed is more than $V_c/200$ (m/min) lower than the withdrawal speed.

In the alternative embodiment, the given lowest speed of the endless belts is higher than the withdrawal speed of the cast metal strip.

In the further alternative embodiment, the driving speed of the endless belts is intermittently increased to a speed higher than the withdrawal speed of the cast metal strip. In this method, the speed variation of the endless belts occurs at constant intervals.

It is a further object of the present invention to provide an apparatus for casting a continuous elongated metal strip and for implementing the casting method according to the invention.

A yet further object of the present invention is to provide a continuous elongated metal strip casting apparatus which ensures a smooth supply of molten metal into a casting chamber.

According to the present invention, the casting apparatus includes a casting chamber into which molten metal is continuously supplied and solidified therein. The casting chamber has a ceiling and a floor constituted by endless belts which move generally with the solidifying metal toward the outlet of the casting chamber. The endless belts are driven at a varying speed centered near the feed rate of the solidifying metal and/or cast metal strip. The belt speed of the endless belts is controlled to vary cyclically or intermittently so as to exert periodic or intermittent changes in acceleration (i.e. jerks) to the metal surfaces opposing the stationary walls of the casting chamber.

The casting apparatus, according to the present invention, may also include a novel metal supply nozzle for continuously supplying molten metal. The nozzle has walls mating with the stationary walls but with its inner surfaces offset inwardly from the inner surfaces of the corresponding stationary walls.

According to another aspect of the invention, an apparatus for casting an elongated metal strip comprises a casting chamber defined by a pair of stationary wall components and a pair of movable wall components, the casting chamber having an inlet for molten metal and an outlet for cast metal strip, a molten metal supply means for continuously supplying molten metal through the inlet of the casting chamber, withdrawing means for withdrawing cast metal strip out of the outlet at a given first speed, and driving means, associated with the movable wall components of the casting chamber, for driving the latter in the withdrawal direction of the cast metal strip at a second speed which is so variable as to apply jerk to the metal within the casting chamber.

Preferably, each of the movable wall components comprises an endless belt stretched between an idle roll and a driving roller, the latter of which is driven by the driving means. The endless belts are aligned vertically so as to defined a ceiling and a floor of the casting chamber and the stationary walls are arranged substantially parallel to each other and form vertical side walls. The endless belts are driven at variable second speed varying between a given highest speed and a given lowest speed.

The driving means cyclically varies the driving speed of the endless belts at a given frequency. In preferred embodiment, the driving means cyclically varies the driving speed of the endless belts at a frequency satisfying the following formula:

$$0<V_c/f<L_n$$

where $V_c$ is the withdrawal speed of the metal strip;

1/f is the period of speed variation of the endless belts; and $L_n$ is the length of the stationary side wall.

The highest driving speed exceeds the withdrawal speed and the lowest driving speed is below the first speed. On the other hand, the lowest speed exceeds the first speed.

In the alternative embodiment, the feeding means varies the first speed cyclically. The withdrawing means varies the first speed at a frequency lower than the frequency of driving speed variation of the endless belt by the driving means.

Alternatively, the driving means intermittently increases the driving speed to the highest speed at regular intervals. The intermittent interval satisfies the aforementioned equation.

According to the invention, the molten metal supply means may comprise a supply nozzle having side walls with ends mating an inlet side end of the stationary wall components, the ends of the side walls of the supply nozzle tapering inwards and the inlet side end of the stationary wall components tapering outwards to conform with the inward taper of the side walls of the supply nozzle. The inside edges of the ends of the side walls of the supply nozzle are offset slightly inwards from the inside edges of the inlet side end of the stationary wall components. The supply nozzle also has a floor having an upper surface lying slightly higher than the movable wall components serving as the floor of the casting chamber.

The idle rolls are disposed near the inlet of the casting chamber and the driving rolls are disposed near the outlet, the idle rollers being rotatable about a rotation axis lying substantially perpendicular to the longitudinal axis of the casting chamber. The end of the floor of the supply nozzle opposing the inlet end of the floor of the casting chamber is offset from the rotation axis in the direction away from the casting chamber.

According to a further aspect of the invention, an apparatus for continuously casting thin, elongated metal strip comprises an elongated casting chamber defined by a plurality of walls which serve as cooling media for molten metal causing solidification of molten metal as it travels therethrough, the casting chamber having an inlet for molten metal and an outlet for a continuous elongated cast metal strip, at least one of the walls comprising an endless belt driven in the withdrawal direction of the solidifying metal within the casting chamber, a molten metal supply means, associated with the inlet of the casting chamber, for continuously supplying molten metal, the molten metal supply means including a supply nozzle in alignment with the casting chamber and having a slightly smaller path cross-section for molten metal than the casting chamber, and withdrawing means for withdrawing cast metal out of the outlet at a given speed.

The casting chamber is defined by a pair of vertical stationary walls and a pair of horizontal endless belts driven in the withdrawal direction of the metal within the casting chamber.

The supply nozzle comprises a pair of vertical side walls having inner vertical surfaces offset inwardly from the inner vertical surface of corresponding stationary walls. The supply nozzle includes a wall forming a floor of the nozzle and having an upper surface lying slightly higher than the upper surface of the endless belt forming the floor of the casting chamber.

In the preferred construction, each of the endless belts is stretched between a pair of rollers respectively located adjacent the inlet and outlet of the casting chamber and rotatable about rotation axis extending perpendicularly to the axis of the casting chamber, and the edge of the nozzle floor nearer the inlet of the casting chamber is offset outwardly from the rotation axis of the rollers nearer the inlet.

BRIEF DESCRIPTION OF THE DRAWINGS

The present invention will be understood more fully from the detailed description given herebelow and from the accompanying drawings of the preferred embodiment of the present invention, which, however, should not be taken to limit the invention to the specific embodiment, but for explanation and understanding only.

In the drawings.

DESCRIPTION OF THE PREFERRED EMBODIMENT

Figure 1:
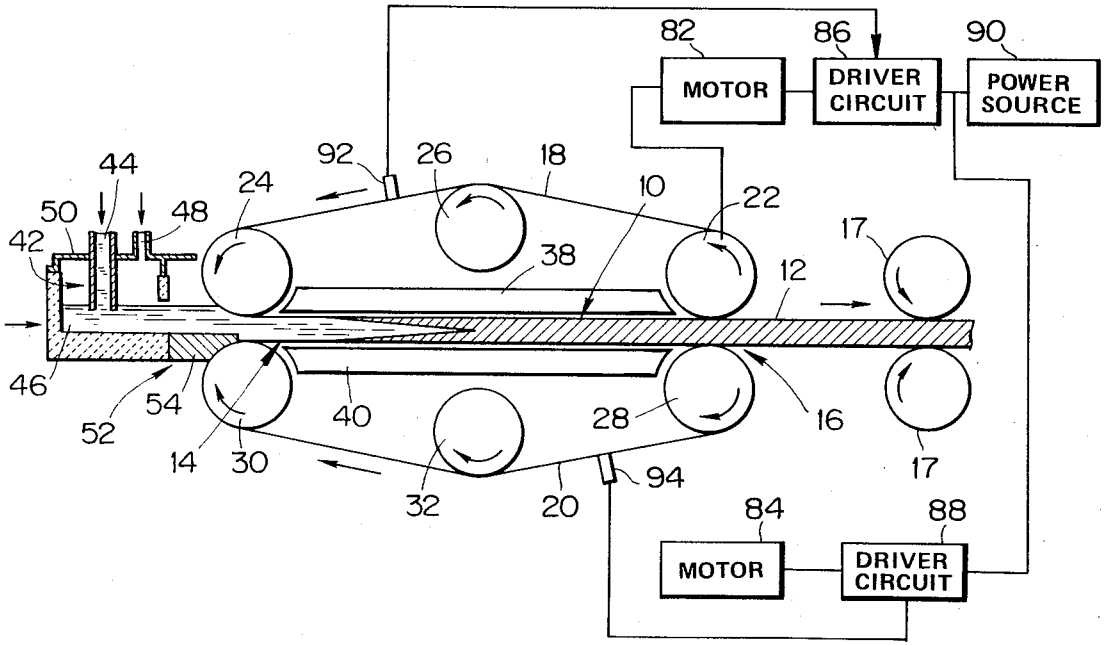
FIG. 1 is a schematic illustration of the preferred embodiment of an apparatus for casting an elongated continuous strip.

Referring now to the drawings, particularly to FIG. 1, the preferred embodiment of a casting apparatus, according to the present invention, defines a casting chamber 10, into which molten metal, such as molten steel, is continuously supplied and in which the molten metal solidifies into continuous metal strip 12. The casting chamber 10 has an inlet 14 connected to a molten metal reservoir, and an outlet 16, through which the solidified metal strip, e.g. thin steel strip is continuously withdrawn. A pair of pinch rollers 17 disposed near the outlet 16 of the casting chamber 10 withdraw the cast metal strip from the casting chamber at a speed.

The casting chamber 10 is defined by a pair of endless belts 18 and 20. The belts 18 and 20 are vertically separated by a fixed distance. The belt 18 serving as the ceiling of the casting chamber 10, will hereafter be referred to as the "upper belt". The upper belt 18 extends over a driving roller 22, an idle roller 24 and a tension roller 26. Similarly, the belt 20 serving as the floor of the casting chamber 10 will hereafter be referred to as the "lower belt". The lower belt 20 extends over a driving roller 28, an idle roller 30 and a tension roller 32. The belts 18 and 20 parallel the feed path of the molten metal through the casting chamber, and so lie horizontal.

The fixed vertical distance between the upper and lower belts 18 and 20 defines the thickness of the metal strip to be cast.

The lateral sides of the casting chamber 10 are closed by a pair of stationary vertical side walls 34 and 36. The stationary side walls 34 and 36 help cool the molten metal introduced into the casting chamber with the aid of cooling water passages 37. The upper and lower belts 18 and 20 respectively enclose cooling pads 38 and 40 which cool the corresponding belts. The cooling pads 38 and 40 discharge or inject cooling water onto the back-sides of the endless belts 18 and 20 to cool same. The upper and lower belts 18 and 20 thus also help cool the metal to expedite its solidification.

The molten metal reservoir is generally represented by the reference numeral 42. The molten metal reservoir 42 has a molten metal supply nozzle 44, through which the molten metal is fed into a reservoir chamber 46. The reservoir chamber 46 also communicates with an inert gas source through an inert gas inlet 48. The inert gas is fed into the reservoir chamber 46 through the inert gas inlet 48. Furthermore, the molten metal reservoir 42 is provided with an atmospheric condition by adjusting cover 50 for adjusting the atmosphere within the reservoir chamber 46.

As shown in FIG. 1, the inlet 14 of the casting chamber 10 opposes the molten metal reservoir 42. The idle rollers 24 and 30 are disposed at the inlet 14. A molten metal feeder nozzle 52 lies between the molten metal reservoir 42 and the inlet 14 of the casting chamber 10. The molten metal feeder nozzle 52 has an essentially U-shaped configuration upwardly opened, defined by a floor 54 and a pair of lateral side walls 56 and 57.

Figure 2:
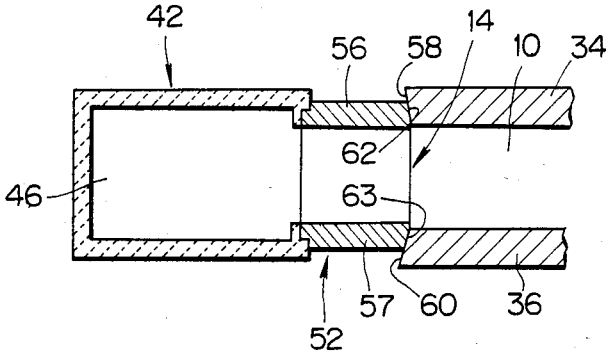
FIG. 2 is an enlarged section through the inlet section of the apparatus of FIG. 1.
Figure 3:
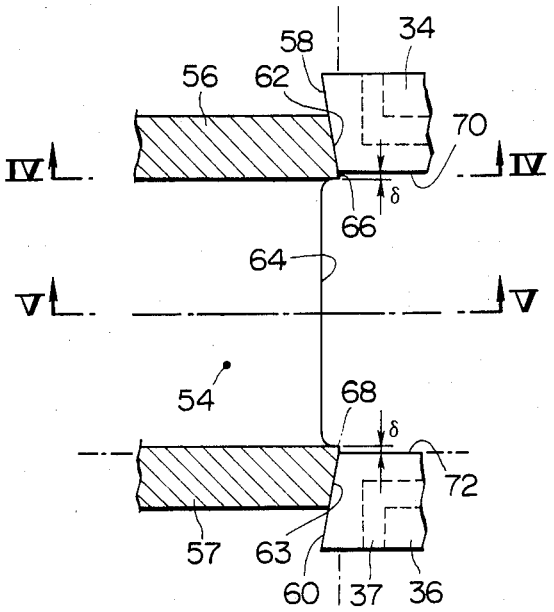
FIG. 3 is a further enlarged section through the inlet section of the apparatus of FIG. 2.

As shown in FIGS. 2 and 3, the stationary side walls 34 and 36 have slightly tapered inlet-side ends 58 and 60 which together form a concavity facing reservoir 42. The side walls 56 and 57 of the molten metal feeder nozzle 52 have slanted ends 62 and 63 matching the inlet-side ends 58 and 60 of the side walls 34 and 36.

The casting chamber end 64 of the floor 54 is recessed slightly toward the reservoir from the inside edges 66 and 68 of the ends 62 and 63 of the side walls 56 and 57, as best shown in FIG. 3. The inside edges 66 and 68 are lie slightly inside of the inner surfaces 70 and 72 of the side walls 34 and 36. This inward offset $\delta$ of the inside edges 66 and 68 is designed to ensure solidification at the inlet 14 where the vertical distance between the upper belt 18 and the lower belt 20 is first apparent. The inward offset $\delta$ should be, in turn, sufficient to ensure that molten metal introduced into the casting chamber 10 will not come into contact with the inlet-side ends 58 and 60 of the stationary side walls 34 and 36 upon entering the casting chamber 10. On the other hand, the inward offset $\delta$ should not be so large as to interfere with the mating ends 58, 60 and 62, 63 of the side walls 34, 36 and 56, 57 or with casting conditions.

Additionally, the slant at the mating edges of the side walls 34, 56 and 36, 57 is selected to assure firm contact in order to prevent molten metal from leaking through the clearance formed otherwise.

Figure 4:
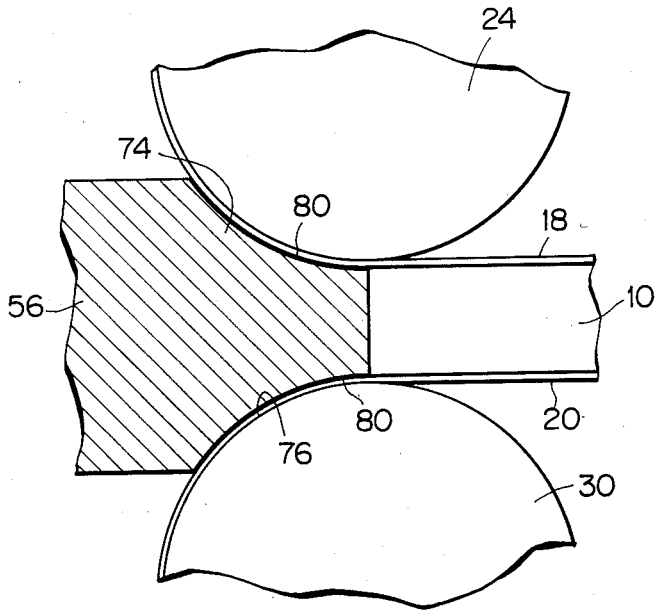
FIG. 4 is a cross-section taken along line IV—IV of FIG. 3.

As shown in FIG. 4, the side walls 56 and 57 of the molten metal feeder nozzle 52 have rounded cut-outs in their upper and lower edges 74 and 76 conforming to the upper and lower idle rollers 24 and 30. The arc of the upper and lower edges 74 and 76 matches the curvature of the corresponding sections of the upper and lower belts 18 and 20 exactly so as to establish firm contact therewith.

Figure 5:
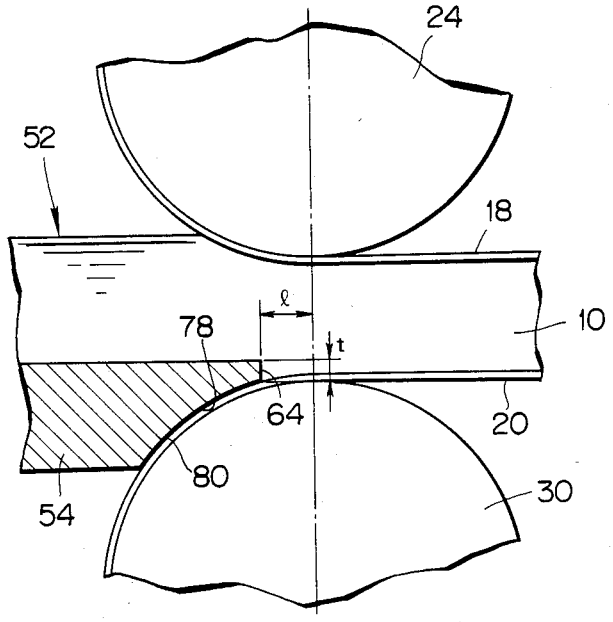
FIG. 5 is a cross-section taken along line V—V of FIG. 3.

Similarly, the edge 78 of the floor 54 opposing the lower idle roller 30 has an arcuate cut-out. The arc of the cut-out corresponds exactly to the curvature of the lower idle roller 30. As will be appreciated from FIG. 5, the upper surface of the floor 54 lies a given height t above the upper surface of the lower belt 20. Furthermore, the end 64 of the floor 54 is offset toward the reservoir 42 from the center of the idle rollers 24 and 30 by a distance $\lambda$. This ensures smooth supply of the molten metal into the casting chamber 10 and thus enables casting of a relatively thin metal strip.

Preferably, a flexible, wear-resistant, refractory heat insulator 80 will line the edges 74, 76 and 78 mating with the running belts 18 and 20. The heat insulator 80 may be made of $Al_2O_3$-system, $Al_2O_3$-$SiO_2$-system or BN-system fibers. Similarly, in order to ensure leak-free contact between the mating edges of the side walls 34, 36 and 56, 57, a flexible heat insulator can line the edges of the molten metal feeder nozzle.

The molten metal feeder nozzle construction described above ensures smooth supply of the molten metal into the casting chamber. In addition, the edges conforming to the belts 18 and 20 prevent leakage of molten metal and afford the molten metal feeder nozzle a sufficiently high durability.

In order to compare the efficiency of the preferred embodiment of the casting apparatus, as set forth above, a metal strip (JIS standard SS41) of 30 mm-thick and 600 mm-width is cast at a withdrawal speed 5 m/min by the conventional apparatus and the apparatus of the preferred embodiment under various conditions. Result and observation of the resultant strip are shown in the following table.

TABLE

| | $\delta$ | L | l | t | HEAT INSULATOR 80 | DAMAGE FLOOR | DAMAGE SIDE WALL | DAMAGE BREAK-OUT | COMPLETE CASTING RATE (%) |
|---|---|---|---|---|---|---|---|---|---|
| COMPARATIVE EXAMPLE | | | | | | | | | |
| 1 | 0 mm | 0 mm | 15 mm | 5 mm | PROVIDED | X | O | O | 33 |
| 2 | 0 | 150 | 0 | 5 | NOT PROVIDED | O | X | X | 0 |
| 3 | 3 | 0 | 0 | 3 | PROVIDED | O | X | O | 5 |
| 4 | 3 | 0 | 15 | 5 | NOT PROVIDED | O | X | X | 25 |

TABLE-continued

| | δ | L | l | t | HEAT INSULATOR 80 | DAMAGE FLOOR | DAMAGE SIDE WALL | DAMAGE BREAK-OUT | COMPLETE CASTING RATE (%) |
|---|---|---|---|---|---|---|---|---|---|
| INVENTION | 3 | 0 | 15 | 5 | PROVIDED | X | X | X | 98 |

(REMARKS)
L: offset of axes of idle rollers;
O: occurred
X: not occurred

As set forth in the introduction, the molten metal supplied into the casting chamber 10 and solidified during travel from the inlet 14 to the outlet 16 tends to be stressed by friction between the opposing surfaces of the stationary side walls 34 and 36 and to be stuck. In order to prevent the solidifying metal in the casting chamber 10 from breaking out due to frictional stress or from sticking, the driving speed of the belts 18 and 20 is cyclically varied. Toward this end, the driving speed of driving motors 82 and 84 connected to the driving rollers 22 and 28 through suitable power trains (not shown) may be controlled. For this purpose, the supply voltage for the driving motors 82 and 84 can be controlled to vary cyclically. Driver circuits 86 and 88 are accordingly provided between a power source 90 and the driving motors 82 and 84.

For accurate motor speed control, sensors 92 and 94 monitor the belt speeds of the upper and lower belts 18 and 20. The sensors 92 and 94 produce sensor signals indicative of the belt speeds as feedback signals. The driver circuits 86 and 88 derive supply voltages for the corresponding driving motors 82 and 84 on the basis of the sensor signal values so as to cyclically vary the belt speed according to predetermined programs.

Figure 6:
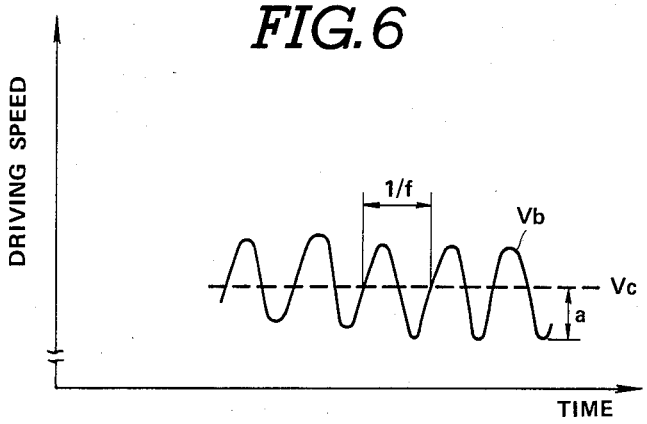
FIG. 6 is a graph of the driving speed of the belts in the preferred embodiment of the apparatus of FIG. 1.

In the preferred embodiment, the belt speeds of the upper and lower belts 18 and 20 vary synchronously according to the characteristic curve shown in FIG. 6. As will be appreciated from FIG. 6, the belt speed varies sinusoidally with a period 1/f (f is the frequency) and a peak-to-peak amplitude *2a*. The frequency f and amplitude *2a* are selected emperically to ensure smooth casting without break-out or sticking of the continuous strip. In practice, the period of the belt speed variation 1/f satisfies the following formula:

$$O < \frac{Vc}{f} <= \text{Ln (mm)}$$

For instance, the feeding pitch of fed metal is greater than 0 mm but equal to or less than 200 mm. Variation amplitude a (m/min) has to be equal to or greater than Vc/200 (m/min).

EXPERIMENTAL EXAMPLE

The preferred embodiment of the casting apparatus according to the present invention was used to cast elongated thin continuous metal strips 20 mm thick and 600 mm wide. The withdrawal speed Vc was set at 5 m/min. The belt speed of the upper and lower belts 18 and 20 was $Vb = Vc + a.\sin 2\pi ft$, where a is 0.16 m/min and f is 83 Hz.

Similar metal strips were cast by the conventional casting apparatus disclosed in the aforementioned Japanese Patent First Publication No. 59-153553 for comparison with the experimental castings by the preferred embodiment of the casting apparatus according to the invention. In the conventional apparatus, break-out occurred in 57% of the attempts and casting was completed successfully in the remaining 43%. However, even the completely cast metal strips revealed a plurality of break-out marks on their surfaces.

On the other hand, in the case of the preferred embodiment of the casting apparatus, 100% of the casts were completed with no break-out marks. Only ripple marks formed by cyclical variation of the belt speed were observed at the surface of the strip.

Figure 7:
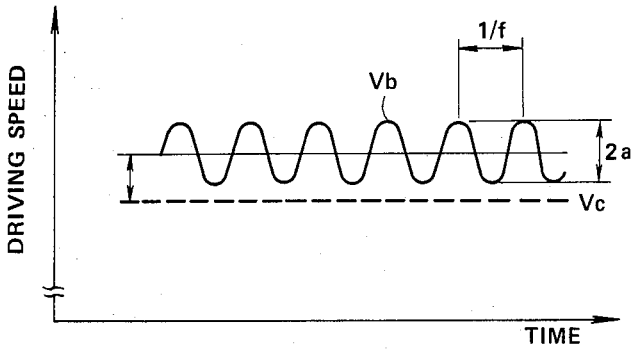
FIGS. 7 to 10 are graphs of different driving speed modulations for the belts in the apparatus of FIG. 1.
Figure 8:
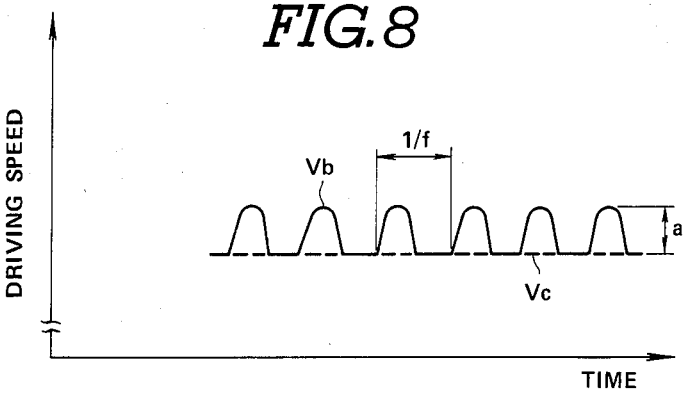

FIGS. 7 and 8 show characteristics of change of belt speed differing from those of FIG. 6. In FIG. 7, the belt speed Vb is maintained above the withdrawal speed Vc which is determined by the rotation speed of the pinch rollers 17. The belt speed Vb is varied sinusoidally as in FIG. 6. On the other hand, in FIG. 8, the belt speed Vb varies between a fixed speed higher than the withdrawal speed Vc and the belt speed Vb.

Varying the belt speed Vb in a speed range above the withdrawal speed Vc of the metal strip applies intermittent impulses to the metal in the withdrawal direction for successfully preventing the metal from breaking out or sticking. Furthermore, varying the belt speed cyclically prevents discontinuities in the solidified metal material, which may otherwise cause cracks when the strip is coiled.

Figure 9:
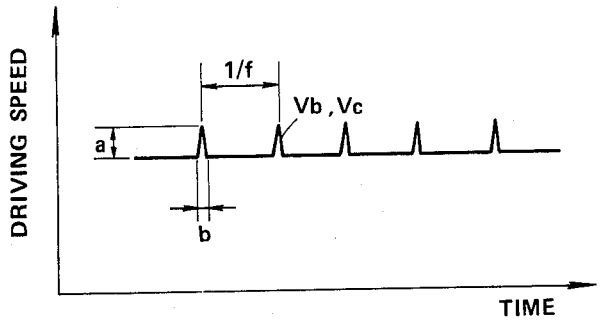
Figure 10:
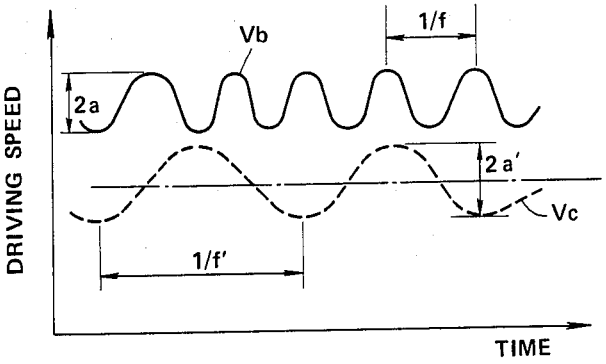

FIGS. 9 and 10 show other patterns of variation of the belt speed and withdrawal speed. In FIG. 9, the belt speed Vb and the withdrawal speed Vc are intermittently increased at regular intervals 1/f. The increases in belt speed Vb and withdrawal speed Vc are preferably about 0.5 m/min and the spike duration b about 0.2 to 0.3 seconds. This intermittent variation of the belt speed and the withdrawal speed also prevents the solidifying metal from breaking out or sticking.

In FIG. 10, the belt speed Vb is maintained above the withdrawal speed Vc. The belt speed and the withdrawal speed vary cyclically according to different characteristics. Specifically, the belt speed varies at approximately 60 cycles per minute and the withdrawal speed varies at approximately 30 cycles per minutes. The amplitude of variation of the belt speed is about 0.30 m/min and that of the withdrawal speed is about 0.15 m/min. In general, the frequency and amplitude of the belt speed variation are about twice those of the feed. In this embodiment, Ln is set to 450 mm.

It should be appreciated that, although in the foregoing preferred embodiment, the belt speed and withdrawal speed are controlled by varying the supply voltage by means of driver circuits, it would also be possible to control those speeds by means of mechanical brakes. In this case, the braking force exerted on the belts 18 and 20 and the pinch rollers 17 may be feedback controlled so as to vary the belt speed and pinch roller speed according to desired characteristics.

Figure 11:
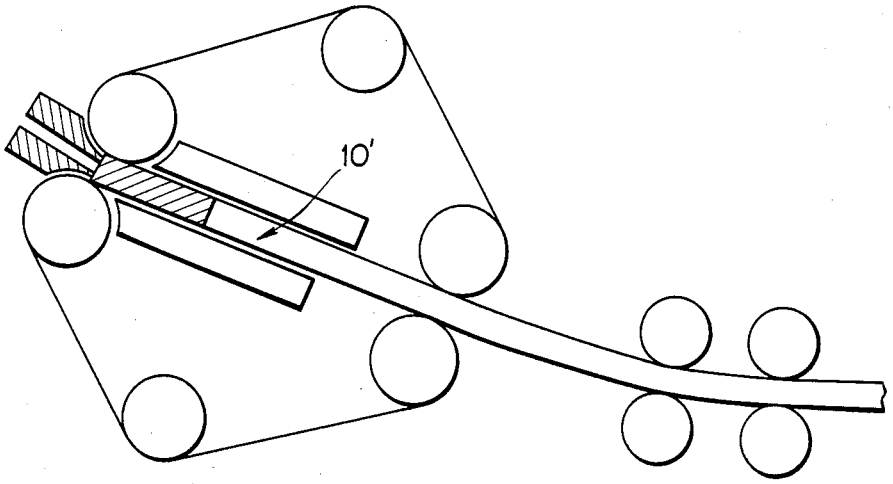
FIG. 11 shows another type of casting apparatus to which the casting method according to the preferred embodiment is applicable.
Figure 12:
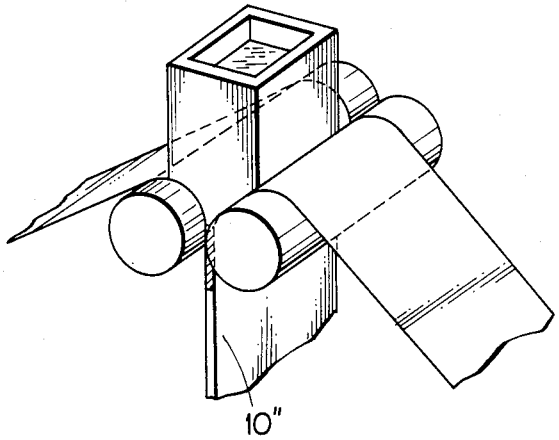
FIG. 12 is a perspective illustration of a different type of casting apparatus capable of performing the preferred casting method according to the invention.

Furthermore, the foregoing casting process for the elongated thin continuous metal strip is applicable not only to the casting apparatus illustrated in FIG. 1 but can be applied to different types of casting apparatus, such as are illustrated in FIGS. 11 and 12. In FIG. 11, the casting chamber 10' lies oblique to the feed path of the cast metal strip. On the other hand, in the casting apparatus of FIG. 12 the casting chamber 10" is vertical.

As will be appreciated herefrom, varying the belt speed and withdrawal speed frees the solidifying metal from the mating surface of the stationary side walls of the casting chamber and so ensures a high yield.

Furthermore, the preferred embodiment of the casting apparatus does not require additional devices for applying vibrations to the stationary side walls, such as are required in the conventional apparatus proposed in Japanese Patent First Publication No. 59-153553. Therefore, the construction of the casting apparatus can be reasonably simple and thus less expensive than the conventional apparatus while still providing a higher yield.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A method for casting a continuous metal strip comprising the steps of:
   - defining an elongated casting chamber with a pair of stationary walls and a pair of endless belts, said casting chamber having an inlet for molten metal and an outlet for a cast metal strip;
   - continuously supplying molten metal through said inlet;
   - withdrawing the metal strip out of said casting chamber through said outlet at a constant speed;
   - solidifying the molten metal supplied through said inlet as it travels toward said outlet within said chamber; and
   - driving said endless belts at a varying speed, thereby applying jerk to the solidifying metal within said casting chamber so as to keep the metal separate from said stationary walls.

2. A method as set forth in claim 1, wherein said driving speed of said endless belts cyclically varies between a given highest speed and a given lowest speed at a given frequency.

3. A method as set forth in claim 2, wherein said highest speed is set above said withdrawal speed of solidified metal and said lowest speed is set below said withdrawal speed.

4. A method as set forth in claim 3, wherein said highest speed is more than $V_c/200$ (m/min) higher than said withdrawal speed, where $V_c$ is said withdrawal speed, and said lowest speed is more than $V_c/200$ (m/min) lower than said withdrawal speed.

5. A method as set forth in claim 1, wherein said given lowest speed of said endless belts is higher than said withdrawal speed of the cast metal strip.

6. A method as set forth in claim 1, wherein said driving speed of said endless belts is intermittently increased to a speed higher than the withdrawal speed of said cast metal strip.

7. A method as set forth in claim 6, wherein said speed variation of said endless belts occurs at constant intervals.

8. An apparatus for casting an elongated metal strip comprising:
   - a casting chamber defined by a pair of stationary wall components and a pair of movable wall components, said casting chamber having an inlet for molten metal and an outlet for cast metal strip;
   - a molten metal supply means for continuously supplying molten metal through said inlet of said casting chamber;
   - withdrawing means for withdrawing cast metal strip out of said outlet at a given first speed; and
   - driving means, associated with said movable wall components of said casting chamber, for driving the latter in the withdrawal direction of said cast metal strip at a second speed which is so variable as to apply jerk to the metal within said casting chamber.

9. An apparatus as set forth in claim 8, wherein each of said movable wall components comprises an endless belt stretched between an idle roll and a driving roller, the latter of which is driven by said driving means.

10. An apparatus as set forth in claim 9, wherein said endless belts are aligned vertically so as to defined a ceiling and a floor of said casting chamber and said stationary walls are arranged substantially parallel to each other and form vertical side walls.

11. An apparatus as set forth in claim 10, wherein said endless belts are driven at variable second speed varying between a given highest speed and a given lowest speed.

12. An apparatus as set forth in claim 11, wherein said driving means cyclically varies the driving speed of said endless belts at a given frequency.

13. An apparatus as set forth in claim 12, wherein said driving means cyclically varies the driving speed of said endless belts at a frequency satisfying the following formula:

$$0<V_c/f<L_n$$

where $V_c$ is the withdrawal speed of said metal strip;

1/f is the period of speed variation of the endless belts; and $L_n$ is the length of the stationary side wall.

14. An apparatus as set forth in claim 11, wherein the highest driving speed exceeds said withdrawal speed and the lowest driving speed is below said first speed.

15. An apparatus as set forth in claim 11, wherein said lowest speed exceeds said first speed.

16. An apparatus as set forth in claim 15, wherein said withdrawing means varies said first speed cyclically.

17. An apparatus as set forth in claim 16, wherein said withdrawing means varies said first speed at a frequency lower than the frequency of driving speed variation by said driving means.

18. An apparatus as set forth in claim 11, wherein said driving means intermittently increases said driving speed to said highest speed at regular intervals.

19. An apparatus as set forth in claim 18, wherein said interval satisfies the following equation:

$$0<V_c/f<L_n$$

where $V_c$ is the withdrawal speed of said metal strip;

1/f is the period of speed variation of the endless belts; and $L_n$ is the length of the stationary side wall.

20. An apparatus as set forth in claim 19, wherein said highest speed exceeds said withdrawal speed.

21. An apparatus as set forth in claim 20, wherein said molten metal supply means comprises a supply nozzle having side walls with ends mating an inlet side end of said stationary wall components, said ends of said side walls of said supply nozzle tapering inwards and said inlet side end of said stationary wall components tapering outwards to conform with the inward taper of said side walls of said supply nozzle.

22. An apparatus as set forth in claim 21, wherein the inside edges of said ends of said side walls of said supply nozzle are offset slightly inwards from the inside edges of said inlet side end of said stationary wall components.

23. An apparatus as set forth in claim 22, wherein said supply nozzle has a floor having an upper surface lying slightly higher than said movable wall components serving as the floor of said casting chamber.

24. An apparatus as set forth in claim 23, wherein said idle rolls are disposed near said inlet of said casting chamber and said driving rollers are disposed near said outlet, said idle rolls being rotatable about a rotation axis lying substantially perpendicular to the longitudinal axis of said casting chamber.

25. An apparatus as set forth in claim 24, wherein the end of said floor of said supply nozzle opposing the inlet end of said floor of said casting chamber is offset from said rotation axis in the direction away from said casting chamber.

* * * * *